US005733392A

United States Patent [19]

Usher

[11] Patent Number: 5,733,392

[45] Date of Patent: Mar. 31, 1998

[54] METHOD OF SURFACE TREATING METAL PARTS

[76] Inventor: Michael Usher, 11 William Dr., East Hampton, Conn. 06424

[21] Appl. No.: 671,921

[22] Filed: Jun. 27, 1996

[51] Int. Cl.[6] ..... C22F 1/16

[52] U.S. Cl. ..... 148/710; 72/53

[58] Field of Search ..... 148/710; 72/53

[56] References Cited

FOREIGN PATENT DOCUMENTS 6-278028 10/1994 Japan ..... 148/710

*Primary Examiner*—Sikyin Ip

*Attorney, Agent, or Firm*—McCormick, Paulding & Huber

[57] ABSTRACT

An apparatus is disclosed for carrying out a method whereby parts are treated in a fluidized bed created within an enclosure that provides for movement of air generally upwardly through the enclosure, and where the parts are passed through the fluidized bed in such a fashion as to present the entire surface of the part to be treated to the particles of the fluidized bed as a result of causing the parts to be treated to follow a circuit within the bed, and wherein the parts are further rotated each on its own axis during said path of travel through the bed.

2 Claims, 1 Drawing Sheet

METHOD OF SURFACE TREATING METAL PARTS

BACKGROUND OF THE INVENTION (1) Field of the Invention

The present invention relates to surface treating of metal pads, and deals more specifically with an improved method of shot peening without need of moving the shot in a high speed stream produced by compressed air or by a centrifugal wheel in accordance with conventional techniques.

(2) Description of the Prior Art

Shot peening is a well-known method of hardening and/or surface treating metal parts, as well as for treating the surface of such parts as turbine blades, for example, in order to improve fatigue life of these turbine blades. Typically, shot peening is accomplished by providing a high speed flow of shot, and supporting a part, such as a turbine blade, in this high speed stream of shot.

SUMMARY OF THE INVENTION

The general purpose and object of the present invention is to provide an improved method for shot peening parts such as turbine blades, and more particularly to provide a method that avoids the necessity for propelling the shot at high speed into the part to be treated.

The foregoing object is accomplished by providing a fluidized bed of suspended shot particles which are preferably or relatively hard materials such as ceramic, glass or steel in an enclosure that provides for continuous supply of the fluid to be moved vertically upwardly through such enclosure, and moving the parts or components to be treated through these suspended particles at a speed sufficient to cause compression at the surface of the parts as a result of the parts striking the suspended particles.

This object is accomplished with the present invention by providing a fluidized bed of suspended particles of relatively hard material in an enclosure that provides for a continuous supply of fluid moving vertically upwardly through the enclosure to support the articles in the fluidized bed, and passing the parts to be treated through these suspended particles at a speed sufficient to cause compression at the surface of the parts as the parts strike the suspended particles.

BRIEF DESCRIPTION OF THE DRAWING

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawing and wherein.

DESCRIPTION OF THE PREFERRED EMBODIMENT

Figure 1:
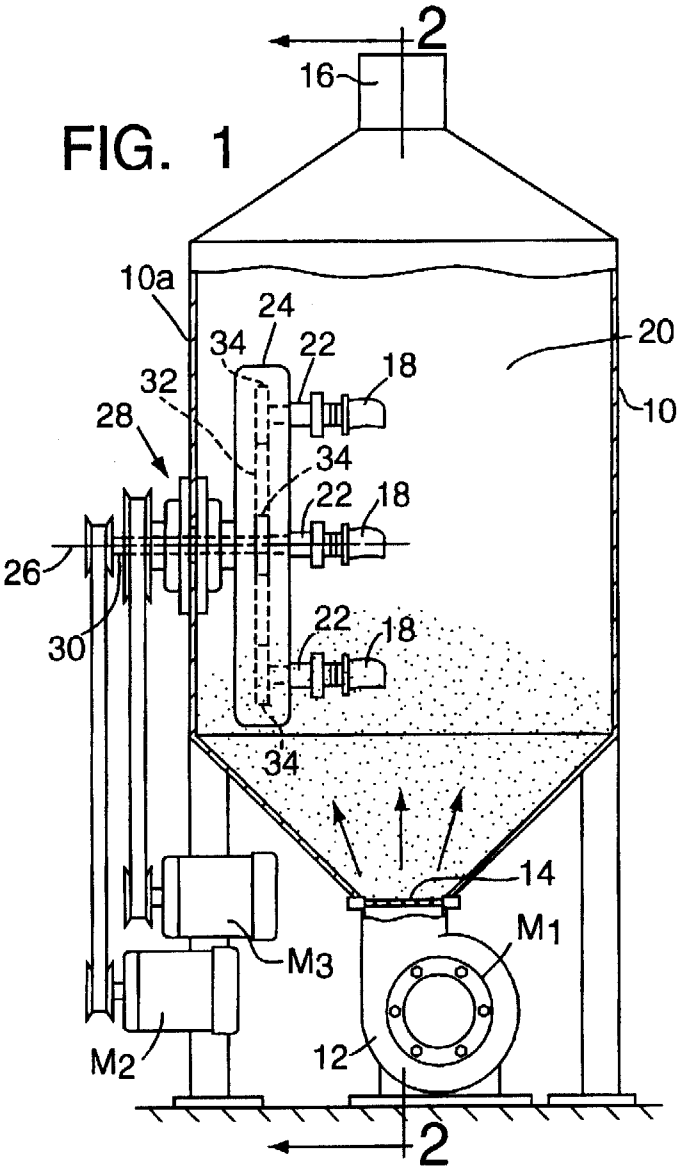
FIG. 1 shows in vertical section, an apparatus capable of practicing the present invention, which apparatus provides one possible environment for the method of the present invention and is illustrated to show one apparatus capable of establishing a fluidized bed of particles in accordance with the present invention.

Referring now to the drawings in greater detail, FIG. 1 shows the enclosure 10 providing an enclosed space in which a fluidized bed is provided with the medium comprising spherical particles. A blower 12 communicates with an opening at the lower end of the enclosure 10 where a screen 14 is provided to support the particles when the blower is turned off. The enclosure 10 further includes an air outlet or exhaust vent 16 at its upper end, and in operation, the blower provides sufficient flow of air or fluid under pressure to support the various particles in the enclosure 10, and to thereby create a fluidized bed of relatively hard, ceramic, glass or steel particles in the interior 20 of the enclosure.

These particles may comprise any suitable material and are preferably of spherical shape such as the shot used in shot peening in the process of cold working metal parts to increase the fatigue life of such parts for example. The present invention is particularly well suited to treating the surfaces of metal turbine blades, and these turbine blades or parts 18, 18 are provided on spindles 22, 22 which spindles are in turn provided on a rotating turret 24 that is supported for rotation on a horizontal axis 26 by a hub structure 28 provided in the side wall 10*a* of the enclosure 10.

It will be appreciated that although the parts 22, 22 shown in the drawings are longitudinally extending turbine blades of the type provided in present day aircraft engines, that these parts may also comprise other components which are to be surface treated for any purpose. It should also be noted that the shot material provided in the fluidized bed in the form of glass, ceramic or steel spheres may also comprise other suitable material, which material need only be hard enough to so treat the surface of the part moved or passed through the fluidized bed as to achieve the desired result and to enhance the characteristics of the surface of such parts.

The blower 12 is preferably driven by an electric motor $M_1$ and comprises a conventional blower of a sufficient horsepower to generate the air flow required to establish a fluidized bed as set forth above.

Figure 2:
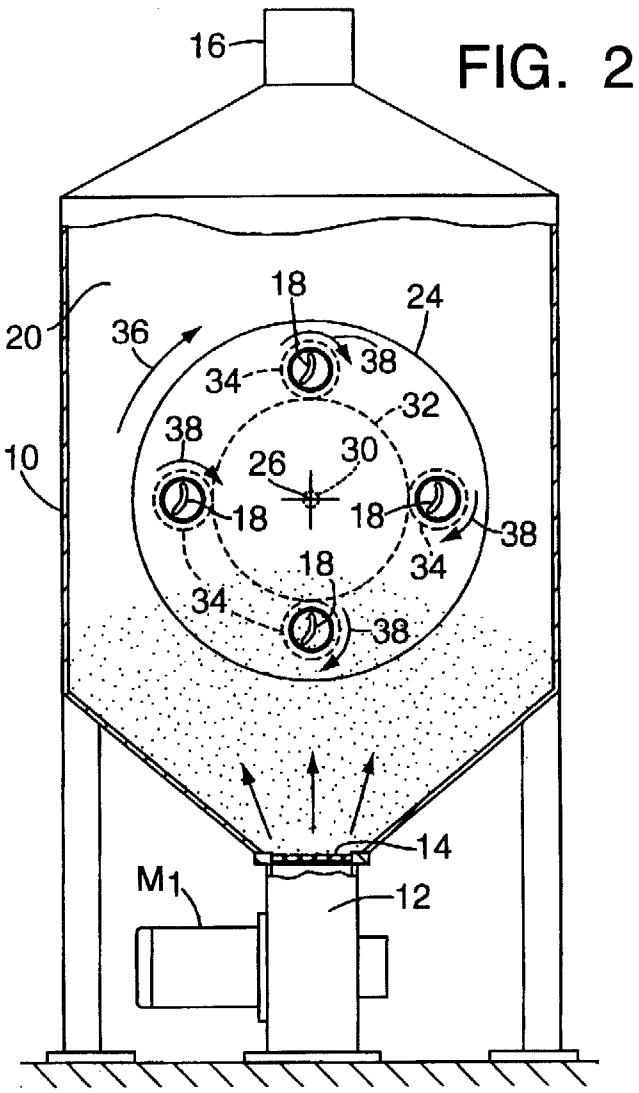
FIG. 2 is a view similar to FIG. 1, but taken on the line 2,2 of FIG. 1.

A second motor $M_2$ is provided as shown in FIG. 1 to an inner shaft 30 which is provided within the shaft associated with the hub 28, and which in turn drives a sun gear provided inside the rotating turret 24. The sun gear drives several planetary gears 34 associated with the spindles 22 described particularly. Each spindle includes a suitable clamping device for supporting a part to be processed in accordance with the present invention. It will be apparent that each of the four spindles shown in FIG. 2 are similarly driven by associated planetary gears from the sun gear 32.

A third motor $M_3$ is provided for rotating the hub structure indicated generally at 28, and for rotating the turret 24. These motors $M_2$ and $M_3$ are preferably of the variable speed drive type so as to achieve a desired relative rotation as between the rotation of each turbine or part 18 on its own axis and on the horizontal axis 26 of the turret As shown in FIG. 2, it may be desirable to rotate the turret in one direction as indicated by the arrow 36 in FIG. 2 while each of the spindles are in turn rotated in the same direction as indicated generally by the arrows 38,38 in FIG. 2.

What is claimed is:

1. A method for treating metal parts to improve their service life, said method comprising:

establishing a fluidized bed of suspended particles in an enclosure that provides for a continuous supply of vertically moving fluid that supports the particles in a suspended fashion within the enclosure, mounting each of said parts for rotation on an associated spindle, and providing a plurality of spindles in a rotary turret so that the parts generally follow a circular path in the fluidized bed, orienting said rotary turret on an axis which results in motion of the parts in a vertical plane, and so that different areas of the parts are subjected to collision with said suspended particles during their circular motion in the rotary turret and as a result of their individual motions on each of the individual spindles.

2. The method according to claim 1 further characterized by orienting the individual axes of rotation of said spindles at right angles to the plane of rotation defined by said rotary turret.

* * * * *